US011247887B2

(12) United States Patent
Hayakawa et al.

(10) Patent No.: US 11,247,887 B2
(45) Date of Patent: Feb. 15, 2022

(54) CONTENT FILLING SYSTEM AND CONTENT FILLING METHOD

(71) Applicant: DAI NIPPON PRINTING CO., LTD., Tokyo-to (JP)

(72) Inventors: Atsushi Hayakawa, Tokyo-to (JP); Nobuki Tsuchimuro, Tokyo-to (JP); Takaharu Hirooka, Tokyo-to (JP)

(73) Assignee: DAI NIPPON PRINTING CO., LTD., Tokyo (JP)

( * ) Notice: Subject to any disclaimer, the term of this patent is extended or adjusted under 35 U.S.C. 154(b) by 272 days.

(21) Appl. No.: 16/015,537

(22) Filed: Jun. 22, 2018

(65) Prior Publication Data

US 2018/0297829 A1 Oct. 18, 2018

Related U.S. Application Data

(63) Continuation of application No. PCT/JP2016/088156, filed on Dec. 21, 2016.

(30) Foreign Application Priority Data

Dec. 22, 2015 (JP) ..... 2015-249890
Dec. 19, 2016 (JP) ..... JP2016-245744

(51) Int. Cl.
*B67C 3/00* (2006.01)
*B67C 3/20* (2006.01)
(Continued)

(52) U.S. Cl.
CPC ..... *B67C 3/007* (2013.01); *B67C 3/06* (2013.01); *B67C 3/20* (2013.01); *B67C 7/00* (2013.01); *B67C 2003/2671* (2013.01)

(58) Field of Classification Search
CPC ..... B67C 3/007; B67C 3/22; B67C 3/225; B67C 3/28; B67C 7/004;
(Continued)

(56) References Cited

U.S. PATENT DOCUMENTS 5,491,333 A * 2/1996 Skell ..... G01F 23/2921 250/222.1
5,538,054 A * 7/1996 Luhmann ..... B67C 3/007 141/198
(Continued)

FOREIGN PATENT DOCUMENTS

DE 4343750 A1 9/1994
DE 10 2008 032 822 A1 1/2010
(Continued)

OTHER PUBLICATIONS

JP-2014125222-A Machine Translation (Year: 2020).*
(Continued)

*Primary Examiner* — Anna K Kinsaul
*Assistant Examiner* — Veronica Martin
(74) *Attorney, Agent, or Firm* — Oliff PLC

(57) ABSTRACT

A content filling system includes a filling device which fills content L in a container which includes a mouth and a container main body. A bubble detecting device is arranged on a downstream side of the filling device, and automatically detects whether or not there are bubbles produced in the content L filled in the container and discharged from the mouth of the container. A determining unit specifies the container which has discharged the bubbles.

8 Claims, 7 Drawing Sheets

(51) Int. Cl.
*B67C 7/00* (2006.01)
*B67C 3/06* (2006.01)
*B67C 3/26* (2006.01)

(58) Field of Classification Search
CPC ..... B67C 2003/2671; B67C 3/06; B67C 3/10; B67C 3/12; B67C 3/20; B67C 7/00
USPC ..... 53/281, 282, 167, 53; 141/95
See application file for complete search history.

(56) References Cited

U.S. PATENT DOCUMENTS

| | | | | | |
|---|---|---|---|---|---|
| 5,642,761 | A * | 7/1997 | Holbrook | B67C 3/06 | 141/104 |
| 6,145,702 | A * | 11/2000 | Lin | B67D 1/1247 | 141/95 |
| 2009/0020412 | A1* | 1/2009 | Takenouchi | B01D 19/0073 | 204/158.2 |
| 2010/0300577 | A1* | 12/2010 | Wagner | B67C 3/22 | 141/1 |
| 2011/0061347 | A1* | 3/2011 | Stoiber | B67B 3/26 | 53/558 |
| 2012/0311962 | A1* | 12/2012 | Hahn | B67C 3/007 | 53/281 |
| 2014/0096863 | A1* | 4/2014 | Herrmann | B67C 3/007 | 141/1 |
| 2016/0046477 | A1* | 2/2016 | Carrara | B67C 7/00 | 53/282 |

FOREIGN PATENT DOCUMENTS

| | | | | | |
|---|---|---|---|---|---|
| EP | 0479030 | A1 | | 4/1992 | |
| JP | S63-218093 | A | | 9/1988 | |
| JP | H03-43397 | A | | 2/1991 | |
| JP | H04-26974 | A | | 1/1992 | |
| JP | H05-081805 | U | | 11/1993 | |
| JP | H06-249969 | A | | 9/1994 | |
| JP | H07-125705 | A | | 5/1995 | |
| JP | H09-218077 | A | | 8/1997 | |
| JP | H09-243328 | A | | 9/1997 | |
| JP | 2002-053198 | A | | 2/2002 | |
| JP | 2004-001840 | A | | 1/2004 | |
| JP | 2006-211931 | A | | 8/2006 | |
| JP | 2006240659 | A | * | 9/2006 | B67C 3/007 |
| JP | 2014-125222 | A | | 7/2014 | |
| JP | 2014125222 | A | * | 7/2014 | |
| JP | 2014-231356 | A | | 12/2014 | |
| WO | 2009/095054 | A1 | | 8/2009 | |
| WO | WO-2009095054 | A1 | * | 8/2009 | B67C 3/222 |
| WO | 2014/077319 | A1 | | 5/2014 | |

OTHER PUBLICATIONS

Aug. 14, 2018 Office Action issued in Japanese Patent Application No. 2017-195285.
Aug. 14, 2018 Office Action issued in Japanese Patent Application No. 2017-195290.
Mar. 19, 2019 Office Action issued in Japanese Patent Application No. 2017-195290.
Jun. 26, 2018 International Preliminary Report on Patentability issued in International Patent Application PCT/JP2016/088156.
Jul. 17, 2019 Extended Search Report issued in European Application No. 16878786.9.
Mar. 28, 2017 International Search Report issued in International Patent Application PCT/JP2016/088156.
Dec. 2, 2016 Japanese Office Action issued in Japanese Patent Application No. 2015-249890.
Mar. 21, 2017 Japanese Office Action issued in Japanese Patent Application No. 2015-249890.
Nov. 4, 2019 Office Action issued in Chinese Patent Application No. 201680073793.7.
Nov. 6, 2020 Office Action issued in Japanese Patent Application No. 2016-245744.
Jun. 30, 2020 Office Action issued in Chinese Patent Application No. 201680073793.7.
Creative Star: Innovative Design and Competition of Modular Robot, pp. 54-55,Sep. 31, 2010.

* cited by examiner

BUBBLE DETECTION HISTORY

| TIME | BUBBLE DETECTING DEVICE WHICH DETECTS | VALVE No. | VALVE TEMPERATURE | LIQUID TEMPERATURE |
|---|---|---|---|---|
| 14:02 | SECOND BUBBLE DETECTING DEVICE | 5 | 18.3°C | 14.1°C |
| 14:02 | SECOND BUBBLE DETECTING DEVICE | 6 | 18.1°C | 14.0°C |
| 14:02 | SECOND BUBBLE DETECTING DEVICE | 7 | 18.0°C | 13.7°C |
| 14:02 | SECOND BUBBLE DETECTING DEVICE | 8 | 18.0°C | 13.9°C |
| 18:03 | FIRST BUBBLE DETECTING DEVICE | 20 | 5.3°C | 5.7°C |
| 18:03 | FIRST BUBBLE DETECTING DEVICE | 20 | 5.1°C | 5.9°C |
| 18:03 | FIRST BUBBLE DETECTING DEVICE | 20 | 5.2°C | 4.9°C |
| ▪ | | | | |
| ▪ | | | | |

FIG. 4

FILLING VALVE ABNORMALITY MONITOR

| VALVE No. | THE NUMBER OF TIMES OF DETECTION | VALVE No. | THE NUMBER OF TIMES OF DETECTION | VALVE No. | THE NUMBER OF TIMES OF DETECTION |
|---|---|---|---|---|---|
| 1 | 1 | 11 | 2 | 21 | 4 |
| 2 | 3 | 12 | 3 | 22 | 2 |
| 3 | 4 | 13 | 1 | 23 | 1 |
| 4 | 2 | 14 | 2 | 24 | 3 |
| 5 | 3 | 15 | 3 | 25 | 4 |
| 6 | 3 | 16 | 1 | 26 | 2 |
| 7 | 2 | 17 | 2 | 27 | 1 |
| 8 | 4 | 18 | 3 | 28 | 0 |
| 9 | 3 | 19 | 2 | 29 | 1 |
| 10 | 1 | 20 | 39 | 30 | 2 |

FIG. 5

CONTENT FILLING SYSTEM AND CONTENT FILLING METHOD

TECHNICAL FIELD

The present invention relates to a content filling system and a content filling method.

BACKGROUND ART

Conventionally, a filling machine such as a filler is used to continuously fill content such as a carbonated drink to multiple plastic bottles conveyed at a high speed (see, for example, Patent Literature 1).

However, some carbonated drink filling conditions produce a great amount of bubbles (also referred to as foaming) from the carbonated drink in part of bottles in some cases. These bubbles are concerned to blow out from mouths of the bottles conveyed at the high speed. When the bubbles blow out from the mouths of the bottles, there are problems that the content quantity of the carbonated drink in the bottles become insufficient compared to a predetermined amount or the carbonated drink adheres to outer circumferences of the mouths of the bottles and causes microbial contamination.

Therefore, conventionally, operators visually inspect whether or not bubbles are blowing out from mouths of bottles conveyed at a high speed. If an operator finds a bottle which blows out bubbles, the operator collectively discards this bottle and bottles conveyed before and after this bottle. Under this background, it is demanded to automatically inspect the bubbles blowing out from the mouth of the bottle without depending on manpower.

CITATION LIST

Patent Literature

Patent Literature 1: JP 2006-211931 A

The present invention has been made in light of such a problem. An object of the present invention is to provide a content filling system and a content filling method which can automatically detect whether or not there are bubbles produced in content filled in a container and discharged from a mouth of the container.

SUMMARY OF INVENTION

The present invention is a content filling system including: a filling device which fills content in a container including a mouth and a container main body; a bubble detecting device which is arranged on a downstream side of the filling device, and automatically detects whether or not there is a bubble produced in the content filled in the container and discharged from the mouth of the container; and a determining unit which is connected to the bubble detecting device and specifies a container which has discharged the bubble.

The present invention is the content filling system in which the bubble detecting device includes a first bubble detecting device which detects the bubble discharged from the mouth immediately after the content is filled in the container, and a second bubble detecting device which is arranged on the downstream side of the first bubble detecting device, and detects the bubble discharged from the mouth when a certain time passes after the content is filled in the container.

The present invention is the content filling system further including an ejection unit which ejects the container which has been specified by the determining unit and has discharged the bubble.

The present invention is the content filling system further including: a cap attachment device which is arranged on the downstream side of the bubble detecting device, and attaches a cap to the mouth of the container, and before the cap attachment device attaches the cap to the mouth of the container, the ejection unit ejects the container which has discharged the bubble.

The present invention is the content filling system further including: a cap attachment device which is arranged on the downstream side of the bubble detecting device, and attaches a cap to the mouth of the container, and the ejection unit is arranged on a downstream side of the cap attachment device.

The present invention is the content filling system in which the cap attachment device conveys the container to the ejection unit without attaching the cap to the mouth of the container which has discharged the bubble.

The present invention is the content filling system further including an adjustment unit which adjusts a filling condition of the filling device based on information from the determining unit.

The present invention is the content filling system in which the bubble detecting device includes a plurality of detecting units disposed in upper and lower directions.

The present invention is the content filling system further including a control unit which stores information related to bubble detection from the determining unit.

The present invention is a content filling method including: a filling step of filling content in a container including a mouth and a container main body; a bubble detecting step of, after the filling step, automatically detecting whether or not there is a bubble produced in the content filled in the container and discharged from the mouth of the container; and a determining step of, after the bubble detecting step, specifying a container which has discharged the bubble.

The present invention is the content filling method, and the bubble detecting step includes a first bubble detecting step of detecting the bubble discharged from the mouth immediately after the content is filled in the container, and a second bubble detecting step of, after the first bubble detecting step, detecting the bubble discharged from the mouth when a certain time passes after the content is filled in the container.

The present invention is the content filling method further including a storing step of storing information related to bubble detection determined in the determining step.

According to the present invention, it is possible to automatically detect whether or not there are bubbles discharged from a mouth of a container after filling of the container.

BRIEF DESCRIPTION OF DRAWINGS

FIG. 4 is a diagram illustrating an example of information stored in a control unit of the content filling system.

FIG. 5 is a diagram illustrating an example of information stored in the control unit of the content filling system.

DESCRIPTION OF EMBODIMENTS

Figure 1:
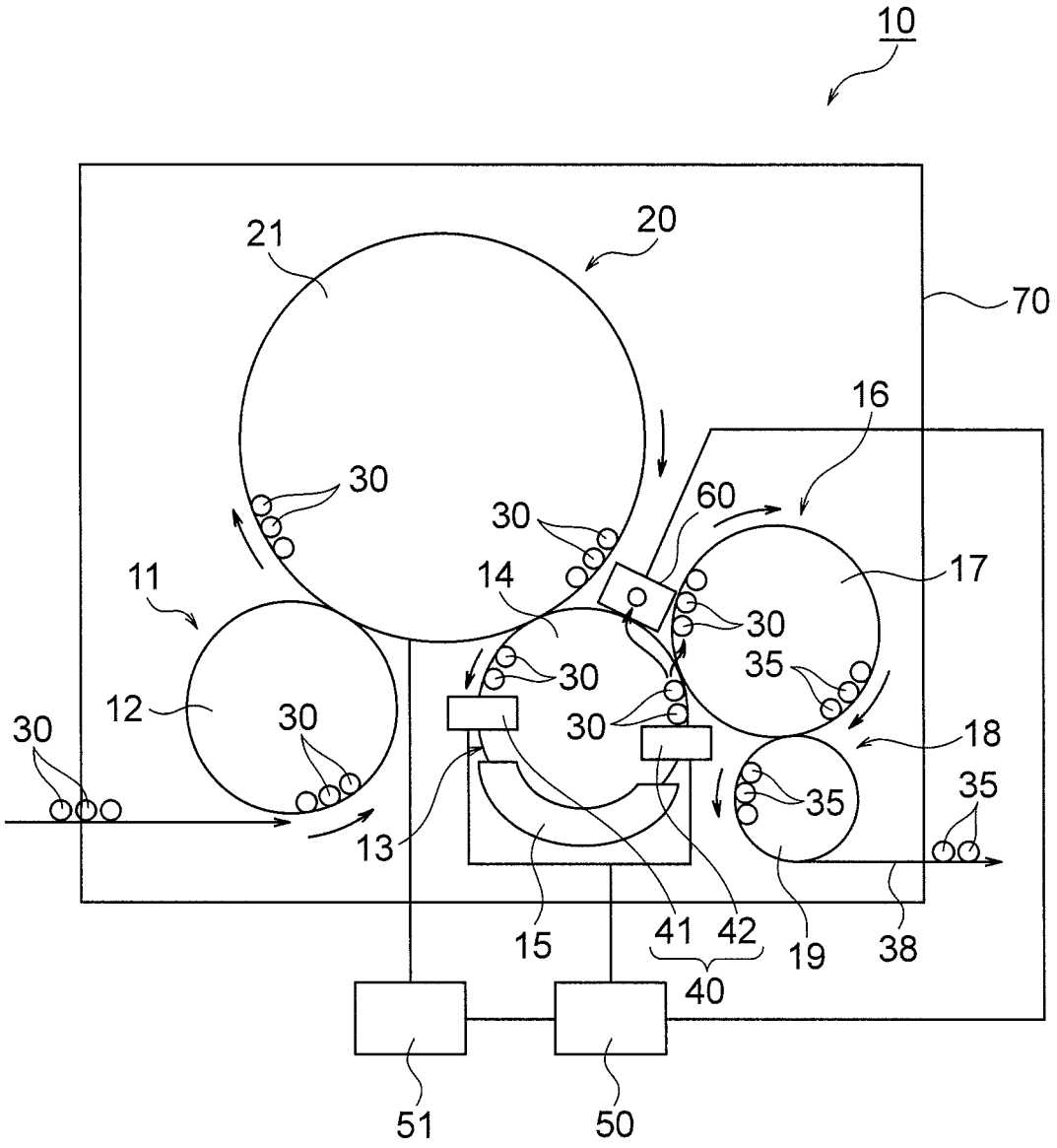
FIG. 1 is a schematic plan view illustrating a content filling system according to one embodiment of the present invention.
Figure 2:
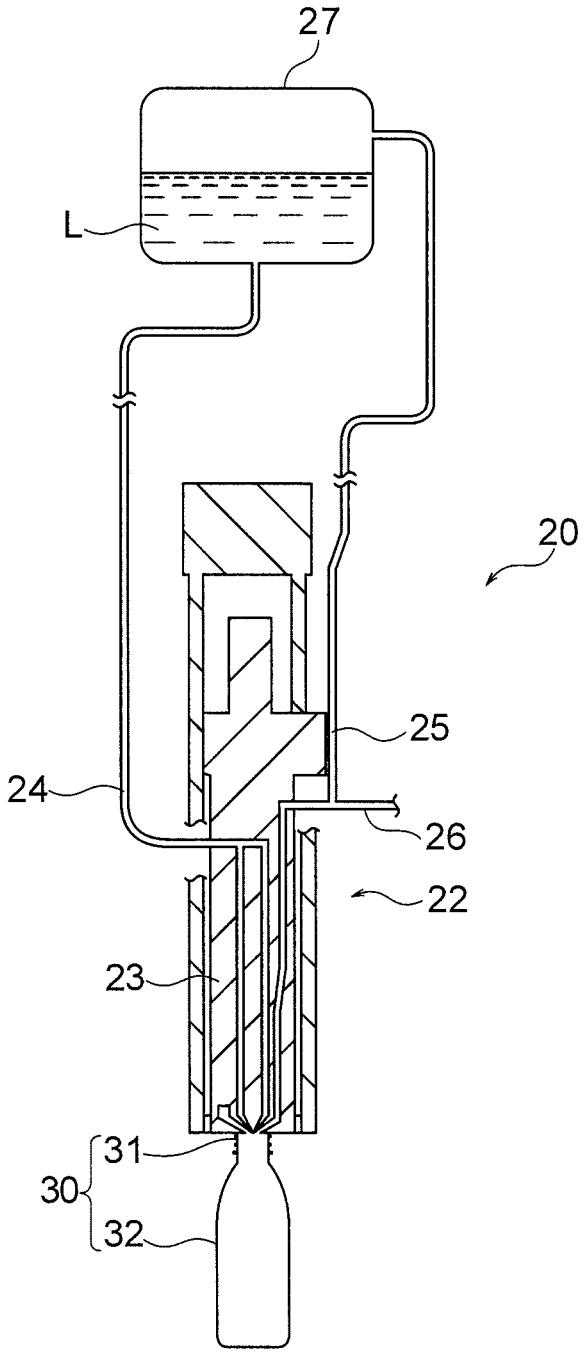
FIG. 2 is a schematic cross-sectional view illustrating filling nozzles provided to a filling device of the content filling system according to one embodiment of the present invention.
Figure 3:
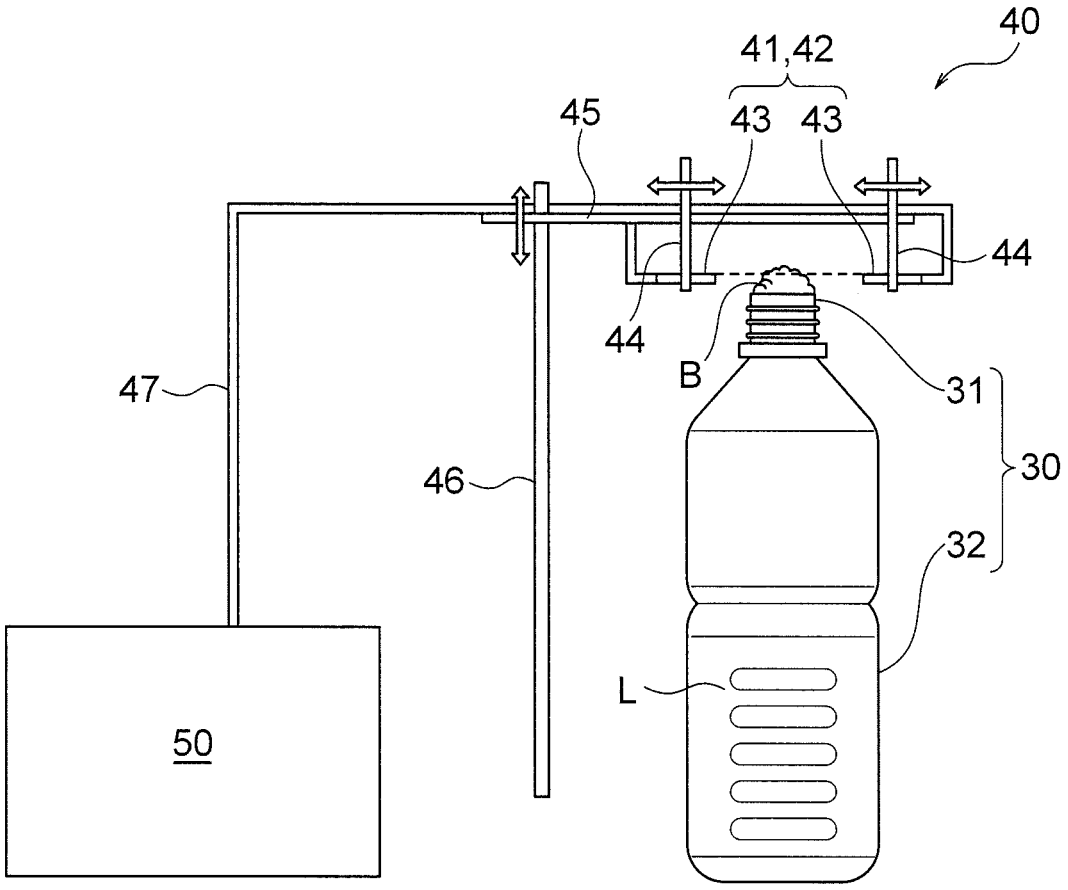
FIG. 3 is a configuration diagram illustrating a bubble detecting device of the content filling system according to one embodiment of the present invention.

An embodiment of the present invention will be described below with reference to the drawings. FIGS. 1 to 3 illustrate one embodiment of the present invention.

(Content Filling System)

First, a content filling system according to the present embodiment will be described with reference to FIGS. 1 to 3.

A content filling system 10 illustrated in FIG. 1 is a system which fills content L such as a carbonated drink to a bottle (container) 30 (see FIG. 3) including a mouth 31 and a bottle main body (container main body) 32. The bottle 30 can be made by performing biaxial stretching blow molding on a preform made by performing injection molding on a synthetic resin material. A material of the bottle 30 to be used is preferably a thermoplastic resin such as PE (polyethylene), PP (polypropylene), PET (polyethylene-terephthalate), or PEN (polyethylene naphthalate). In addition, the container may be a glass, a can, paper, a pouch, or a composite container of these. The present embodiment will describe an example of a case where a bottle is used for the container.

As illustrated in FIG. 1, the content filling system 10 includes an inlet side conveying device (inlet wheel) 11, a filling device (filler) 20, an outlet side conveying device (outlet wheel) 13, a cap attachment device (a capper, a seamer, and a capping machine) 16, and a transfer device 18. These inlet side conveying device 11, filling device 20, outlet side conveying device 13, cap attachment device 16, and transfer device 18 are disposed in this order along a conveying direction of the bottle 30 and from an upstream side to a downstream side.

The inlet side conveying device 11 successively receives the empty bottle 30 from an outside to the content filling system 10, and conveys the received bottle 30 to the filling device 20. The inlet side conveying device 11 includes a rotary convey wheel 12. This convey wheel 12 rotates (revolves) a plurality of bottles 30 to be continuously conveyed to the filling device 20.

The filling device 20 fills the content L from the mouth 31 of the bottle 30 into the bottle main body 32. This filling device 20 fills the content L in the empty bottle 30.

The filling device 20 includes a rotary convey wheel 21. This convey wheel 21 rotates (revolves) a plurality of bottles 30 to fill the content L inside the bottles 30. Furthermore, a plurality of filling nozzles 22 (see FIG. 2) is disposed along an outer circumference of the convey wheel 21. Each filling nozzle 22 has one bottle 30 attached thereto, and injects the content L inside the bottle 30.

As illustrated in FIG. 2, the filling nozzles 22 are known, and each include a main body 23, and a content supply line 24 and a gas supply line 25 which are connected to the main body 23. The content supply line 24 among these parts has an upper end connected to a head tank 27 (or a filler bowl) filled with the content L, and a lower end in communication with an inside of the bottle 30. Furthermore, the content L supplied from the head tank 27 passes through the content supply line 24, and is injected inside the bottle 30. Furthermore, the gas supply line 25 has an upper end connected to the head tank 27, and a lower end in communication with the inside of the bottle 30. A counter pressure gas such as carbon dioxide supplied from the head tank 27 passes through the gas supply line 25 and is filled inside the bottle 30. A midpoint of the gas supply line 25 is connected with a snift line 26, and can exhaust the gas inside the bottle 30 via the snift line 26.

When the content L is a carbonated drink, a temperature of the content L while the content L is filled by the filling nozzle 22 is, for example, 1° C. to 10° C. and is preferably 5° C. to 10° C. A reason that the temperature of the content L is, for example, 1° C. to 10° C. in this way is that, when a liquid temperature exceeds 10° C., the carbon dioxide readily escapes from the content L.

The content L is a liquid which easily causes foaming after filling, and includes various beverages containing carbon dioxide such as carbonated drinks such as ciders and colas, and alcoholic beverages such as beers. The content L may be uncarbonated beverages. The uncarbonated beverages include all beverages such as teas, functional drinks, juices, coffees, milks, and drinks with milk, other than mineral water. Alternatively, the content L may be non-beverage liquids including surfactants such as a dishwashing detergent, a laundry detergent, and a liquid soap.

Referring to FIG. 1 again, the outlet side conveying device 13 is arranged on the downstream side of the filling device 20. The outlet side conveying device 13 conveys the bottle 30 which has been filled with the content L by the filling device 20 yet is not still capped, to the cap attachment device 16. The outlet side conveying device 13 includes a rotary convey wheel 14. This convey wheel 14 rotates (revolves) a plurality of bottles 30 to be continuously conveyed to the cap attachment device 16.

The outlet side conveying device 13 is provided with a nozzle unit 15. This nozzle unit 15 includes an unillustrated mouth cleaning nozzle and/or inert gas (nitrogen) replacing nozzle. The mouth cleaning nozzle is a nozzle for cleaning the mouths 31 of the continuously conveyed bottles 30 by a cleaning solution or a cleaning gas. Furthermore, the inert gas replacing nozzle is a nozzle for replacing a gas in head spaces of the continuously conveyed bottles 30 with the inert gas.

While the outlet side conveying device 13 conveys the bottle 30, bubbles are produced in the content L filled in the bottle 30 in some cases. When the amount of bubbles is small, the bubbles stay inside the bottle 30. However, when the amount of bubbles is large, the bubbles are discharged from the mouth 31 to the outside in some cases. Hence, in the present embodiment, the outlet side conveying device 13 is provided with a bubble detecting device 40 which automatically detects whether or not there are bubbles discharged from the mouth 31 of the bottle 30.

In the present embodiment, the bubble detecting device 40 includes a first bubble detecting device 41 which is located closer to the upstream side than the nozzle unit 15, and a second bubble detecting device 42 which is located closer to the downstream side than the first bubble detecting device 41 and the nozzle unit 15. The first bubble detecting device 41 among these devices detects bubbles discharged from the mouth 31 immediately after the content L is filled in the bottle 30. On the other hand, the second bubble detecting device 42 detects bubbles discharged from the mouth 31 when a certain time passes after the content L is filled in the bottle 30.

The bubbles produced from the content L have different growth rates due to various factors such as a type and a filling speed of the content L. Therefore, both of the first bubble detecting device 41 on the upstream side and the second bubble detecting device 42 on the downstream side are provided. Consequently, bubbles of a high growth rate discharged from the mouth 31 immediately after the content L is filled in the bottle 30 (while the bubbles reach the first bubble detecting device 41 after the content L is filled) can be detected by the first bubble detecting device 41. Further, bubbles of a low growth rate discharged from the mouth 31 when the certain time passes after the content L is filled in the bottle 30 (while the bubbles reach the second bubble detecting device 42 after the bubbles pass through the first bubble detecting device 41) can be detected by the second bubble detecting device 42. Consequently, it is possible to detect various bubbles of different growth rates. In addition, another bubble detecting device may be further arranged at a different position from those of the first bubble detecting device 41 and the second bubble detecting device 42.

The first bubble detecting device 41 and the second bubble detecting device 42 of the bubble detecting device 40 are respectively connected with a determining unit 50. The determining unit 50 has a function of, when the first bubble detecting device 41 and/or the second bubble detecting device detect the bottle 30 which has discharged bubbles, specifying the bottle 30 which has discharged the bubbles. A method for specifying the bottle 30 which has discharged the bubbles is not limited, yet may include, for example, assigning a position number to a portion at which each bottle 30 is housed in the convey wheel 21 of the filling device 20, causing the determining unit 50 to recognize the position number corresponding to each passing bottle 30 when each bottle 30 passes through the first bubble detecting device 41 or the second bubble detecting device 42, and specifying the bottle 30 which has discharged the bubbles. Furthermore, sensors which detect the bottles 30 may be provided at an inlet and an outlet of the filling device 20 to specify the position of each bottle 30.

In view of FIG. 3, the first bubble detecting device 41 and the second bubble detecting device 42 of the bubble detecting device 40 each include a pair of photoelectric sensors (detecting units) 43 and 43. A pair of photoelectric sensors 43 and 43 is disposed above the mouth 31 of the bottle 30, and on both sides of bubbles B (both sides of a traveling direction of the bottle 30) discharged from the mouth 31. A pair of photoelectric sensors 43 and 43 is attached to brackets 44. Each bracket 44 is attached horizontally movably to a horizontal attachment member 45. Furthermore, the horizontal attachment member 45 is attached to a fixing member 46 movably in a vertical direction. Consequently, it is possible to adjust an interval between a pair of opposing photoelectric sensors 43 and 43 and height positions of the photoelectric sensors 43 with respect to the mouth 31. In addition, conventionally known sensors can be used as the photoelectric sensors 43. In the present embodiment, the first bubble detecting device 41 and the second bubble detecting device 42 employ the same configuration yet is not limited to this. The first bubble detecting device 41 and the second bubble detecting device 42 may employ different configurations.

The photoelectric sensors 43 are connected to the determining unit 50 via a communication cable 47. The determining unit 50 may be an arithmetic operation device such as a computer. Furthermore, an unillustrated amplifier or sequencer may be interposed between the photoelectric sensors 43 and the determining unit 50. In addition, the detecting units are not limited to the transmission type photoelectric sensors 43, and reflection type photoelectric sensors may be used. Alternatively, displacement sensors disposed above the bottle 30 may be used as the detecting units, or a camera disposed on a side (or an oblique side) of the bottle 30 may be used.

Referring to FIG. 1 again, the determining unit 50 is connected to an adjustment unit (control unit) 51. This adjustment unit 51 adjusts filling conditions of the filling device 20 based on information from the determining unit 50. The filling conditions include, for example, a movement speed (filling time) of the bottle 30 in the filling device 20, a filling amount of the content L, a filling temperature, a pressure during filling (counter pressure), a retaining time, a snift time, and adjustment (a time and a quantity) of large amount filling and small amount filling. Thus, the information is fed back from the determining unit 50 and the adjustment unit 51 adjusts the filling conditions of the filling device 20, so that it is possible to fill the content L under the filling conditions that bubbles are hardly discharged from the mouth 31. Consequently, it is possible to reduce the bottles 30 which discharge bubbles from the mouths 31, and improve a product yield. Furthermore, when a liquid type of the content L differs, a bubble production situation also differs. Conventionally, a filling element is put under various conditions one by one, and an optimal filling process matching one liquid type is created by visual inspection. However, it is possible to automatically learn statistically which element contributes the most to a bubble production mechanism of the bottle 30 conveyed at a high speed by this content filling system 10. Furthermore, a result obtained during manufacturing can be fed back to the filling process in real time. Consequently, it is possible to perform an optimization operation as filling starts even when a liquid type differs every day, and automatically derive the optimal filling process.

In addition, the determining unit 50 is formed separately from the adjustment unit 51 yet is not limited to this. The determining unit 50 and the adjustment unit 51 may be integrally formed in one device. Furthermore, a control unit which controls the entire content filling system 10 may function as the determining unit 50 and the adjustment unit 51.

Furthermore, in the present embodiment, the adjustment unit (control unit) 51 stores information related to whether or not bubbles are detected from the determining unit 50, and controls the filling device 20 based on the stored information. That is, the adjustment unit 51 may control the filling device 20 based on the stored information, adjust the filling conditions (described above) of the filling device 20, and optionally operate or stop the filling device 20. For example, the adjustment unit 51 may calculate a bubble detection rejection rate (the number or a rate of the bottles 30 from which bubbles have been detected) from information related to bubble detection from the determining unit 50, and determine an optimal filling parameter of the filling device 20 based on this bubble detection rejection rate. Furthermore, the adjustment unit 51 may feed back the filling conditions based on this optimal filling parameter to the filling device 20. Alternatively, the adjustment unit 51 may determine that a trouble occurs in the filling device 20 and stop the filling device 20 when the bubble detection rejection rate is high.

FIG. 4 illustrates an example of information related to bubble detection and stored in the adjustment unit 51. In FIG. 4, "time" indicates a time at which bubbles are detected, a "bubble detecting device which detects" bubbles indicates a bubble detecting device which detects the bubbles among the first bubble detecting device 41 and the second bubble detecting device 42, a "valve No." indicates an identification number of a valve (filling nozzle 22) which has filled the content L in the bottle 30, a "valve temperature" is a surface temperature of the valve which has filled the content L in the bottle 30, and a "liquid temperature" indicates a temperature of the content L filled in the bottle 30.

In this case, the adjustment unit 51 can calculate a bubble production temperature (a valve temperature and/or a liquid temperature at or around time 14:02 in FIG. 4) unique to the filled content L. By feeding back this bubble production temperature to the filling device 20, it is possible to determine the optimal filling temperature of the filling device 20. More specifically, the adjustment unit 51 may control the filling device 20 such that the filling temperature of the content L in the filling device 20 does not exceed the bubble production temperature. Furthermore, when the liquid temperature of the content L rises due to an abnormality or temporary stop of a facility of the content filling system 10, and the filling temperature of the content L reaches the bubble production temperature, the adjustment unit 51 may stop automatic supply of the bottle 30 to the filling device 20. Consequently, it is possible to prevent production of foaming in the content L in the bottle 30.

Furthermore, when a failure of a valve of the filling device 20 such as a change or an abnormality in an operation of an air cylinder connected to a specific valve of the filling device 20 or an air supply path (an operation of a solenoid valve) connected to a specific valve occurs, the bottle 30 is likely to discharge bubbles in some cases. Hence, the adjustment unit 51 may broadcast the abnormality by an alarm or an indication when bubbles are frequently detected from the bottle 30 filled by using a specific valve (a No. 20 valve in FIG. 4). In this case, an operator can decide that there is a sign of a failure in a specific valve of the filling device 20, and consequently improve a facility operation rate and a product yield by taking an appropriate measure for the valve.

FIG. 5 illustrates another example of information related to bubble detection and stored in the adjustment unit 51. In FIG. 5, the "valve No." indicates a valve (filling nozzle 22) identification number, and "the number of times of detection" indicates the number of the bottles 30 from which bubbles have been detected in a predetermined period. In FIG. 5, it is found that bubbles are intensively detected from the bottle 30 filled from the No. 20 valve (the number of times of detection is 39). In this case, the operator can decide that a failure occurs in the No. 20 valve of the filling device 20, and consequently improve a facility operation rate and a product yield by taking an appropriate measure for the No. 20 valve.

In addition, in the present embodiment, the control unit which controls the filling device 20 is used as the adjustment unit 51 which adjusts the filling conditions of the filling device 20, yet is not limited to this. The control unit and the adjustment unit 51 may be separately formed.

Referring to FIG. 1 again, an ejection unit 60 which ejects the bottles 30 is arranged on the downstream side of the outlet side conveying device 13 and the bubble detecting device 40. The ejection unit 60 is connected to the determining unit 50. This ejection unit 60 selectively ejects the bottle 30 which has been specified by the determining unit 50 and has discharged the bubbles. When, for example, a position number is assigned to each portion at which each bottle 30 is housed in the convey wheel 21 of the filling device 20, the determining unit 50 specifies the position number corresponding to the bottle 30 which has discharged the bubbles, and transmits the position number to the ejection unit 60. When the bottle 30 housed at the corresponding position number reaches, the ejection unit 60 selects and ejects this bottle 30. On the other hand, the bottle 30 from which the bubbles have not been detected by the bubble detecting device 40 is conveyed to the cap attachment device 16 without being conveyed to the ejection unit 60.

The cap attachment device 16 is arranged on the downstream side of the outlet side conveying device 13 and the bubble detecting device 40. This cap attachment device 16 caps the bottle 30 by attaching an unillustrated cap to the mouth 31 of the bottle 30. The cap attachment device 16 includes a rotary convey wheel 17. This convey wheel 17 rotates (revolves) a plurality of bottles 30 to attach caps to the mouths 31 and continuously convey the bottles 30 to the transfer device 18. Thus, by attaching the cap to the mouth 31 of the bottle 30, it is possible to obtain a bottle 35 filled with content.

The transfer device 18 conveys the bottle 35 filled with the content and with the cap attached by the cap attachment device 16 from the cap attachment device 16 to an outside of the content filling system 10. The cap attachment device 16 includes a rotary convey wheel 19. An outlet conveyer 38 is connected to the transfer device 18. This convey wheel 19 rotates (revolves) a plurality of bottles 35 filled with the content to be passed to the outlet conveyer 38 and continuously conveyed to the outside of the content filling system 10.

In addition, the content filling system 10 includes a chamber 70. The chamber 70 houses the above inlet side conveying device 11, filling device 20, outlet side conveying device 13, cap attachment device 16, and transfer device 18.

This content filling system 10 may be, for example, a sterile filling system. In this case, the interior of the chamber 70 is kept in a sterile state. Alternatively, when the content L is a beverage such as a cola which does not need to be sterilized, the interior of the chamber 70 may be a clean room from which foreign materials have been removed.

(Content Filling Method)

Next, a content filling method according to the present embodiment will be described. The content filling method according to the present embodiment is performed by using the above content filling system 10 (FIG. 1).

First, a plurality of empty bottles 30 is sequentially supplied from the outside of the content filling system 10 to the inlet side conveying device 11. These bottles 30 are rotated and conveyed by the convey wheel 12 of the inlet side conveying device 11, and are transferred to the filling device 20.

Subsequently, the bottles 30 are held by the convey wheel 21 in the filling device 20 and are rotated (revolved) by the convey wheel 21 such that the content L is filled in the bottle main bodies 32 from the mouths 31 (filling process).

Next, in the filling device 20, the filling nozzles 22 closely adhere to the mouths 31 of the bottles 30, so that the gas supply line 25 and the bottles 30 communicate with each other. Next, a counter pressure gas is supplied from the gas supply line 25 into the bottle 30. Thus, an inner pressure of the bottle 30 is made higher than an atmospheric pressure, and the inner pressure of the bottle 30 is the same pressure as the inner pressure of the head tank 27 (see FIG. 2).

Next, the content L is filled inside the bottle 30 from the content supply line 24. In this case, the content L passes through the content supply line 24 from the head tank 27

(see FIG. 2), and is injected inside the bottle 30. During this injection, large amount filling and small amount filling may be switched.

Subsequently, supply of the content L from the content supply line 24 is stopped. Subsequently, the snift line 26 is opened, and the gas inside the bottle 30 is exhausted from the snift line 26.

Subsequently, the pressure inside the bottle 30 becomes equal to the atmospheric pressure, and filling the content L in the bottle 30 is finished. In this case, bubbles are produced in the content L in the bottle 30, and are discharged from the mouth 31 to the outside in some cases.

Subsequently, the bottle 30 filled with the content L is transferred from the filling device 20 to the outlet side conveying device 13 (see FIG. 1). In this case, the bottle 30 is rotated and conveyed by the convey wheel 14 of the outlet side conveying device 13, and is transferred to the first bubble detecting device 41 of the bubble detecting device 40.

Subsequently, the first bubble detecting device 41 automatically detects whether or not there are bubbles (bubbles discharged immediately after filling in particular) discharged from the mouth 31 of the bottle 30 (first bubble detecting process). More specifically, when the bubbles discharged from the mouth 31 pass through sensing regions of a pair of photoelectric sensors 43 and 43 (see FIG. 3) of the first bubble detecting device 41, the photoelectric sensors 43 detect the bubbles. In this case, the photoelectric sensors 43 output signals to the determining unit 50 (see FIG. 1).

Subsequently, the determining unit 50 specifies the bottle 30 which has discharged the bubbles based on the signals from the photoelectric sensors 43 (determining process). When, for example, a position number is assigned to each portion at which each bottle 30 is housed in the convey wheel 21 of the filling device 20, the determining unit 50 specifies the position number corresponding to the bottle 30 which has discharged the bubbles. Subsequently, the determining unit 50 transmits the position number corresponding to the bottle 30 which has discharged the bubbles, to the ejection unit 60.

In addition, when the photoelectric sensors 43 of the first bubble detecting device 41 do not detect the bubbles, the photoelectric sensors 43 do not transmit the signals to the determining unit 50.

Irrespectively of whether or not the mouth 31 discharges the bubbles, the bottle 30 having passed through the first bubble detecting device 41 passes in the nozzle unit 15, and, during this time, the mouth 31 is cleaned and/or the gas in the head space is replaced with the inert gas. When a cleaning device in the nozzle unit 15 is used, water scatters around the convey wheel 14, shields light from the photoelectric sensors 43 and becomes noise in some cases. In this case, air may be blown to light receiving units of the photoelectric sensors 43 to remove water. The chamber 70 is a sterile chamber, and, when used in this sterile chamber, sterilized cleaning water and air need to be used.

The bottle 30 having passed in the nozzle unit 15 is subsequently rotated and conveyed by the convey wheel 14, and is transferred to the second bubble detecting device 42. Next, the second bubble detecting device 42 automatically detects whether or not there are bubbles (bubbles discharged when a certain time passes after filling in particular) discharged from the mouth 31 of the bottle 30 (second bubble detecting process).

When the second bubble detecting device 42 detects the bubbles discharged from the mouth 31, the second bubble detecting device 42 transmits a signal to the determining unit 50, and the determining unit 50 specifies the bottle 30 which has discharged the bubbles (determining process). Next, the determining unit 50 transmits the position number corresponding to the bottle 30 which has discharged the bubbles, to the ejection unit 60.

In addition, a detecting method of the second bubble detecting process is substantially the same as that of the first bubble detecting process. Furthermore, in the present embodiment, the first bubble detecting process and the second bubble detecting process configure a bubble detecting process.

Next, the bottle 30 having passed through the second bubble detecting device 42 reaches the vicinity of the ejection unit 60 (see FIG. 1). In this case, the ejection unit 60 selects the bottle 30 which has discharged the bubbles based on the signal from the determining unit 50, and ejects this bottle 30 from the outlet side conveying device 13. In addition, the ejection unit 60 may select and eject the bottle 30 from which the bubbles have been detected by one of the first bubble detecting device 41 and the second bubble detecting device 42, or may select and eject the bottle 30 from which the bubbles have been detected by both the first bubble detecting device 41 and the second bubble detecting device 42.

On the other hand, the bottle 30 from which bubbles have not been detected is conveyed from the outlet side conveying device 13 to the cap attachment device 16 (see FIG. 1). This cap attachment device 16 attaches an unillustrated cap to the mouth 31 of the bottle 30, so that it is possible to obtain the bottle 35 filled with the content (cap attaching process).

Subsequently, the bottle 35 filled with the content is conveyed from the cap attachment device 16 to the transfer device 18 and is conveyed from the transfer device 18 to the outside of the content filling system 10.

In addition, in the present embodiment, the information related to whether or not bubbles are detected from the determining unit 50 is sent to the adjustment unit (control unit) 51, and is stored by the adjustment unit 51 (storing process). In this case, the adjustment unit 51 controls the filling device based on the stored information. For example, the adjustment unit 51 may control the filling device 20 based on the stored information, adjust the filling conditions (described above) of the filling device 20, and optionally operate or stop the filling device 20.

In addition, in the present embodiment, a production (convey) speed of the bottle 30 is preferably 100 bpm to 1500 bpm. Here, bpm (bottle per minute) refers to a convey speed of the bottle 30 per minute.

As described above, according to the present embodiment, the bubble detecting device 40 automatically detects whether or not there are bubbles produced in the content L filled in the bottle 30 and discharged from the mouth 31 of the bottle 30. Furthermore, the determining unit 50 specifies the bottle 30 which has discharged the bubbles. Consequently, it is possible to automatically detect whether or not there are the bubbles discharged from the mouth 31 of the bottle 30 without depending on manpower of the operator. As a result, it is possible to prevent a failure that the quantity of the content L in the bottle 30 is insufficient compared to a predetermined quantity or the content L adheres to the outer circumference of the mouth 31.

Conventionally, an operator visually inspects whether or not there are bubbles, and collectively discards the bottles 30 which are concerned to blow out the bubbles. However, according to the present embodiment, it is possible to select and discard only the bottles 30 which have produced bubbles from the mouths 31. Consequently, it is possible to reduce the number of the bottles 30 to be discarded and improve the product yield.

Furthermore, according to the present embodiment, the bubble detecting device 40 includes the first bubble detecting device 41 which detects bubbles discharged from the mouth 31 immediately after the content L is filled in the bottle 30, and the second bubble detecting device 42 which detects the bubbles discharged from the mouth 31 when a certain time passes after the content L is filled in the bottle 30. Consequently, the bubble detecting device 40 can detect various bubbles of different growth rates, and reliably remove the bottle 30 which has discharged the bubbles from the mouth 31.

Furthermore, according to the present embodiment, the ejection unit 60 which ejects the bottle 30 which has discharged the bubbles is provided, so that it is possible to automatically remove the bottle 30 which has discharged the bubbles reliably.

Furthermore, according to the present embodiment, the ejection unit 60 ejects the bottle 30 which has discharged the bubbles before the cap attachment device 16 attaches the cap to the mouth 31 of the bottle 30. Consequently, there is no concern that the cap is attached to the bottle 30 which needs to be discarded, and it is possible to prevent the cap from being wasted.

Furthermore, according to the present embodiment, there is provided the adjustment unit 51 which adjusts the filling conditions of the filling device 20 based on the information from the determining unit 50. Furthermore, the adjustment unit 51 stores the information related to bubble detection from the determining unit 50. This adjustment unit 51 stores the information from the determining unit 50 and feeds back the information to the filling device 20, so that it is possible to learn a relationship between the filling conditions of the filling device 20 and bubble production. Furthermore, the adjustment unit 51 can adjust the filling conditions of the filling device 20 such that bubbles are hardly discharged from the mouth 31, based on the information from the determining unit 50.

(Modification)

Figure 6:
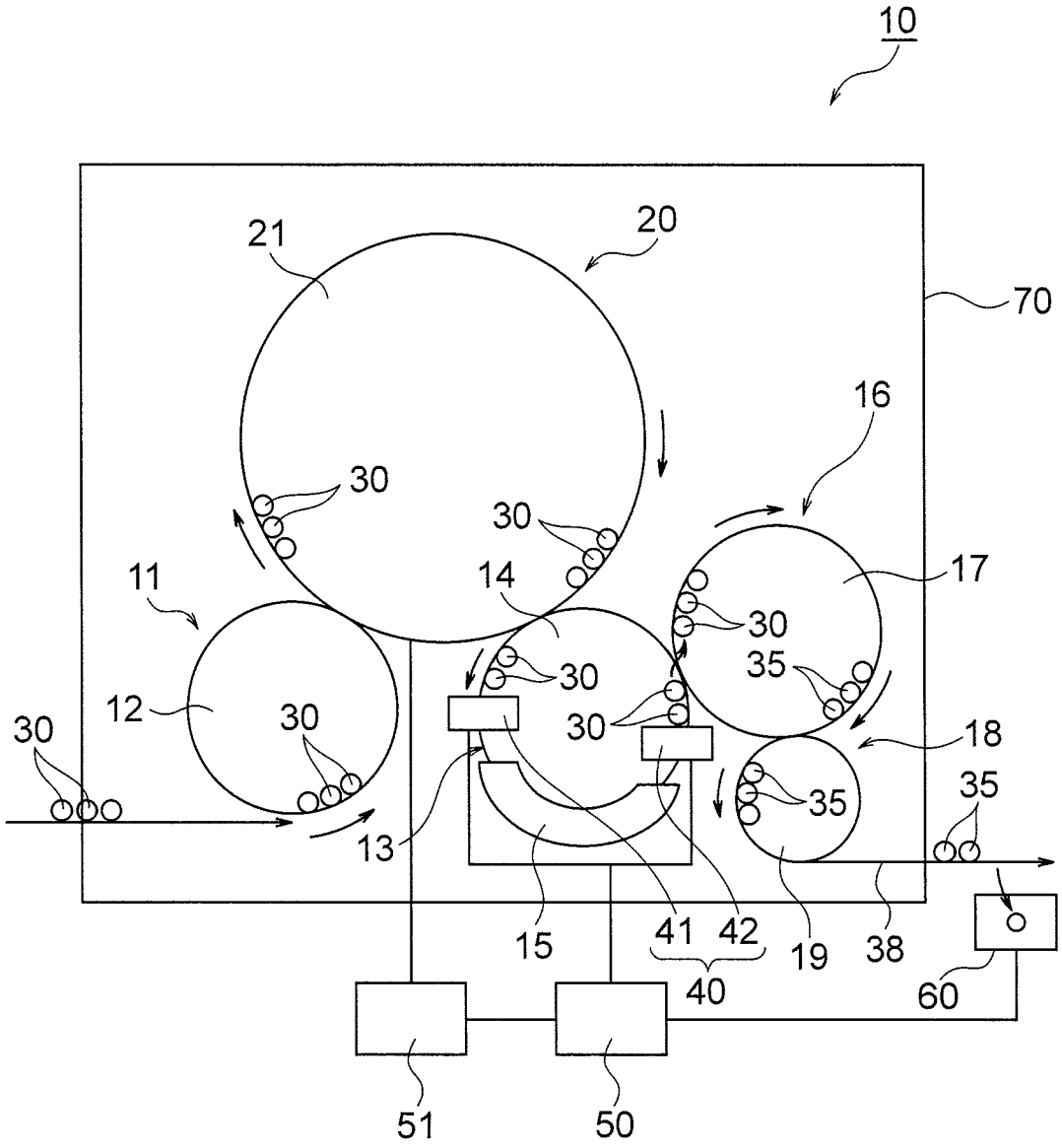
FIG. 6 is a schematic plan view illustrating a modification of the content filling system.
Figure 7:
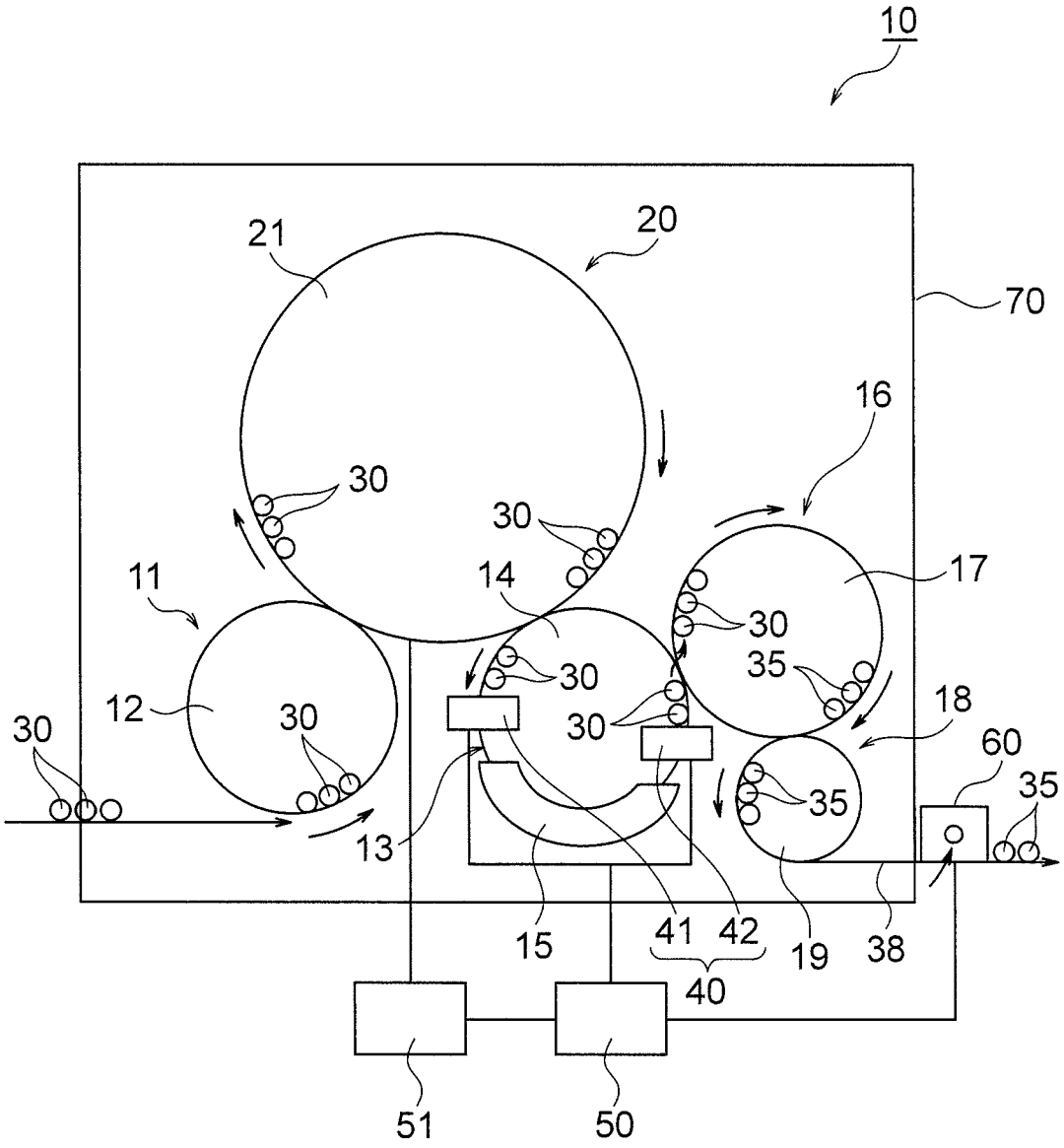
FIG. 7 is a schematic plan view illustrating the modification of the content filling system.
Figure 8:
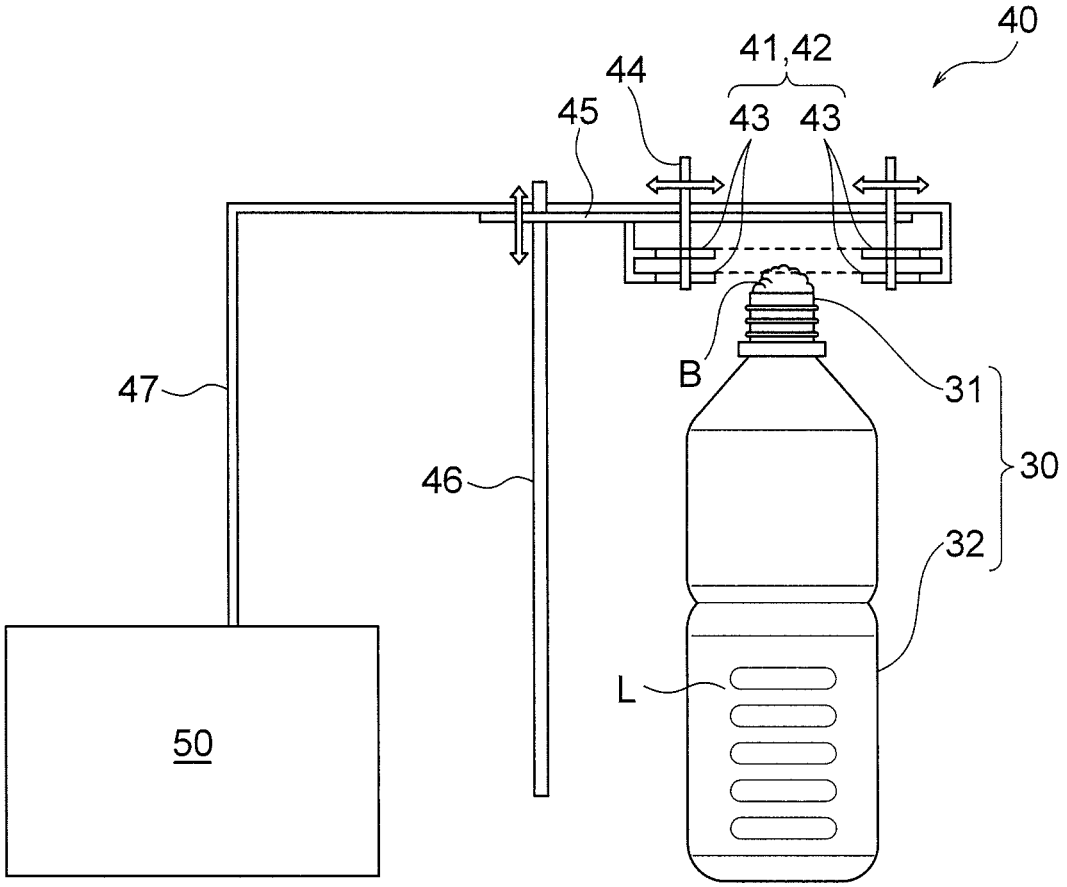
FIG. 8 is a configuration diagram illustrating the modification of the bubble detecting device.

Next, each modification of the present embodiment will be described with reference to FIGS. 6 to 8. In FIGS. 6 to 8, the same portions as those in the embodiment illustrated in FIGS. 1 to 3 will be assigned with the same reference numerals and will not be described in detail.

The above embodiment has described the example of the case where the ejection unit 60 is arranged closer to the upstream side than the cap attachment device 16, yet is not limited to this. As illustrated in, for example, FIG. 6, the ejection unit 60 may be arranged on the downstream side of the cap attachment device 16. Consequently, the ejection unit 60 does not need to be disposed in a space around the outlet side conveying device 13. It is possible to effectively use a space around the outlet side conveying device 13. In this case, the cap attachment device 16 preferably conveys the bottle 30 to the ejection unit 60 without attaching the cap (not illustrated) to the mouth 31 of the bottle 30 which has discharged bubbles. Consequently, the cap is not attached to the bottle 30 which needs to be discarded, so that it is possible to prevent the cap from being wasted.

Alternatively, as illustrated in FIG. 7, the ejection unit 60 may be provided to the outlet conveyer 38. The bottles 30 which have discharged the bubbles are conveyed at predetermined pitches, and therefore are removed from the outlet conveyer 38 by the ejection unit 60 provided to the outlet conveyer 38. In this case, the cap may be seamed or may not be attached.

Furthermore, as illustrated in FIG. 8, the first bubble detecting device 41 and/or the second bubble detecting device 42 of the bubble detecting device 40 may include a plurality of (e.g., two) photoelectric sensors (detecting units) 43 and 43 in upper and lower directions. In this case, it is possible to detect the bubbles B of different heights discharged from the mouth 31. For example, the photoelectric sensor 43 located on a lower side can detect the bubbles B of a relatively low height, and the photoelectric sensor 43 located on an upper side can detect the bubbles B of a relatively high height.

Example

Next, a specific example of the present embodiment will be described.

The content filling system 10 illustrated in FIG. 1 was used, and the bottle 30 which had discharged bubbles from the mouth 31 was prepared and was caused to pass between a pair of photoelectric sensors 43 and 43 to confirm whether or not it was possible to actually detect bubbles. In this regard, a convey speed of the bottle 30 was 720 bpm.

Three types of a dishwashing detergent, a cola, and a melon cream soda were prepared as the content L to conduct tests five times for each content.

As a result, even in each case where the content L is one of the dishwashing detergent, the cola, and the melon cream soda, the bubbles discharged from the mouth 31 could be detected (see Table 1).

TABLE 1

| | FIRST TIME | SECOND TIME | THIRD TIME | FOURTH TIME | FIFTH TIME | RESULT |
|---|---|---|---|---|---|---|
| DISHWASHING DETERGENT | ○ | ○ | ○ | ○ | ○ | DETECTABLE |
| COLA | ○ | ○ | ○ | ○ | ○ | DETECTABLE |
| MELON CREAM SODA | ○ | ○ | ○ | ○ | ○ | DETECTABLE |

The invention claimed is:

1. A content filling system comprising:

a filling device which fills content in a container including a mouth and a container main body;

an outlet side conveying device that is arranged on a downstream side of the filling device, and configured to convey the container after it has been filled with the content by the filling device and before the container has been capped;

a bubble detecting device which is provided at the outlet side conveying device, and automatically detects whether or not there is a bubble produced in the content filled in the container and discharged from the mouth of the container; and a determining unit which is connected to the bubble detecting device and specifies a container which has discharged the bubble, wherein the outlet side conveying device is provided with a nozzle unit that includes a mouth cleaning nozzle and/or an inert gas replacing nozzle, the bubble detecting device includes:

a first bubble detecting device that is arranged on an upstream side of the nozzle unit, and detects the bubble discharged from the mouth of the container conveyed by the outlet side conveying device, immediately after the content is filled in the container, and a second bubble detecting device that is arranged on the downstream side of the first bubble detecting device and the nozzle unit, and detects the bubble discharged from the mouth of the container conveyed by the outlet side conveying device, when a certain time passes after the content is filled in the container.

2. The content filling system according to claim 1, further comprising an ejection unit which ejects the container which has been specified by the determining unit and has discharged the bubble.

3. The content filling system according to claim 2, further comprising a cap attachment device which is arranged on the downstream side of the bubble detecting device, and attaches a cap to the mouth of the container, wherein, before the cap attachment device attaches the cap to the mouth of the container, the ejection unit ejects the container which has discharged the bubble.

4. The content filling system according to claim 2, further comprising a cap attachment device which is arranged on the downstream side of the bubble detecting device, and attaches a cap to the mouth of the container, wherein the ejection unit is arranged on a downstream side of the cap attachment device.

5. The content filling system according to claim 4, wherein the cap attachment device conveys the container to the ejection unit without attaching the cap to the mouth of the container which has discharged the bubble.

6. The content filling system according to claim 1, further comprising an adjustment unit which adjusts a filling condition of the filling device based on information from the determining unit.

7. The content filling system according to claim 1, wherein the bubble detecting device includes a plurality of detecting units disposed in vertically upper and lower directions with relation to each other.

8. The content filling system according to claim 1, further comprising a control unit which stores information related to bubble detection from the determining unit.

* * * * *